US006257117B1

(12) United States Patent
Yagishita

(10) Patent No.: US 6,257,117 B1
(45) Date of Patent: Jul. 10, 2001

(54) CYLINDER APPARATUS

(75) Inventor: Ryuzo Yagishita, Tokyo (JP)

(73) Assignee: Nambu Co., Ltd., Tokyo (JP)

( * ) Notice: Subject to any disclaimer, the term of this patent is extended or adjusted under 35 U.S.C. 154(b) by 0 days.

(21) Appl. No.: 09/531,327

(22) Filed: Mar. 20, 2000

(30) Foreign Application Priority Data

Mar. 23, 1999 (JP) ..... 11-077508

(51) Int. Cl.[7] ..... F01B 7/20

(52) U.S. Cl. ..... 91/169; 91/189 R; 60/560; 164/314

(58) Field of Search ..... 164/314, 312, 164/317, 318, 315; 425/595, 451.9; 92/62, 65; 60/560, 563, 571; 91/169, 173, 189 R

(56) References Cited

U.S. PATENT DOCUMENTS 3,483,798 * 12/1969 Parrett et al. ..... 91/169
4,455,923 * 6/1984 Muller ..... 91/349
4,773,300 * 9/1988 Klatt et al. ..... 91/169 R
5,483,796 * 1/1996 Ando ..... 60/560

FOREIGN PATENT DOCUMENTS

2623075 * 6/1997 (JP) ..... F15B/15/14

* cited by examiner

*Primary Examiner*—Kuang Y. Lin
*Assistant Examiner*—Len Tran
(74) *Attorney, Agent, or Firm*—Sughrue, Mion, Zinn, Macpeak & Seas, PLLC

(57) ABSTRACT

The inside of a cylinder is divided into front and rear cylinder chambers, a primary-side piston and a secondary-side piston, each formed by an annular disc part and an annular tube part are fitted into each cylinder chamber, with the annular tube parts of each loosely fitted together, and the secondary-side piston surrounding an operating piston rod so as to hold the operating piston and being fit into the operating piston. The first front cylinder chamber and the second rear cylinder chamber defined by the primary- and secondary-side pistons are connected by a communicating passageway with a relief valve inserted therein, this relief valve being switched to the open condition by either a prescribed pressure or a valve opening/closing bar that is provided upright on the primary-side piston.

3 Claims, 8 Drawing Sheets

CYLINDER APPARATUS

BACKGROUND OF THE INVENTION

1. Field of the Invention

The present invention relates to a fluid cylinder for driving a die applied to a die-casting or injection machine or the like, and more particularly to a cylinder apparatus that pulls a piston rod with a strong force at the time of opening a die, and operates quickly at other stages.

2. Description of the Related Art

In a die-cast machine or an injection machine, at the stage at which a die is set into a cavity and closed, there is generally a need for quick movement, but no need for a large driving force, while at the stage of opening a die, at the initial, short step of peeling the die away from the product during cooling, there is a need for a large driving force. However, once the die is peeled away to the open condition, there is a need for quick retraction of the die, similar to the case of the step in which the die is set.

Seen from the cylinder side, in the above-noted steps there is a need for quick drive at the step in which the piston rod is extended, and a need for a large driving force at the initial step of pulling in the piston rod after it is extended, after which there is a need for quick retraction.

With respect to the need for the above-described functional requirements, cylinder apparatuses having a variety of constructions have been developed in the past, an exemplary one being that of Japanese Patent No. 2623075, granted for a "fluid cylinder."

This fluid cylinder is shown in FIG. 13 of the accompanying drawings, and is described as "fluid cylinder comprising a cylinder casing 113 having its interior formed with a main cylinder chamber 111 and a pressure intensifying cylinder chamber 112; a main piston 117, slidably housed in said main cylinder chamber 111 and provided with a piston rod 114 linked to a load on its front edge side, for sectioning said main cylinder chamber 111 into a front main cylinder subchamber 115 positioned on the front side and a rear main cylinder subchamber 116 positioned on the rear side; a front supply/discharge path 118, formed within said cylinder casing 113, for supplying a fluid to said front main cylinder subchamber 115; a rear supply/discharge path 119, formed within said cylinder casing 113, for supplying the fluid to said rear main cylinder subchamber 116; and a pressure intensifying piston 123, slidably housed in said pressure intensifying cylinder chamber 112, for sectioning said pressure intensifying cylinder chamber 112 into first and second pressure intensifying cylinder subchambers 120 and 121 positioned on one side but shut off from each other in terms of a fluidity and an other-side pressure intensifying cylinder subchamber 122 positioned on the other side, wherein said first pressure intensifying cylinder subchamber 120 is connected to said front main cylinder subchamber 115, said second pressure intensifying cylinder subchamber 121 is connected to said rear supply/discharge path 119, said other-side pressure intensifying cylinder subchamber 122 is connected to said front supply/discharge path 118, a large fluid force acting backward is imparted to said main piston 117 by guiding a high pressure generated in said first pressure intensifying cylinder subchamber 120 to said front main cylinder subchamber 115 with a movement of said pressure intensifying piston 123 toward one side when the fluid is supplied from said front supply/discharge path 118 to said other-side pressure intensifying cylinder subchamber 122, and said pressure intensifying piston 123 is, on the other hand, moved up to an other-side limit in advance of said main piston 117 when the fluid is supplied from said rear supply/discharge path 119 to said rear main cylinder subchamber 116 and said second pressure intensifying cylinder subchamber 121."

While it is difficult to comprehend from the above-noted basic constitution alone, with regard to, as recited in a dependent claim, the pressure intensifying piston 123 must be interpreted as "being constructed of a cylindrical portion 124 and a disc member 125 having its outer periphery integrally linked to the inner periphery of the other edge portion of said cylindrical portion, said first pressure intensifying cylinder subchamber 120 is, at the same time, disposed in a face-to-face position with one edge surface of said cylindrical portion 124, said second pressure intensifying cylinder subchamber 121 is disposed in a face-to-face position with one edge surface of said disc member 125, said other-side pressure intensifying cylinder subchamber 122 is disposed in a face-to-face position with the other edge surface of said disc member 125, and said cylindrical portion 124 is, further, slidably fitted to the outer portion of said main piston 117.

The first pressure intensifying cylinder subchamber 120 and front main cylinder subchamber 115 are connected by forming a path within the main piston 117, and a valve 126 is provided midway in the rear supply/discharge path 119, when the rear supply/discharge path 119 or front supply/discharge path 118 is at a set pressure, receives this pressure and opens, and which is closed when both the supply/discharge paths 118 and 119 are at a low pressure, the closed valve 126 causing fluid locking of the rear main cylinder subchamber 116, thereby limiting the movement of the main piston 117.

Referring to the patent publication, the operation of the above-noted fluid cylinder is as follows. (Because this application omits the drawings that illustrate the operation steps described below, it is recommended that the drawings in the cited patent publication be referred to as the following description is read.)

First, the main piston 117 (referring collectively to the large-diameter piston 127 and the small-diameter piston 128) is at the forward limit, the large-diameter piston 127 being in contact with the bottom part of the first cylinder tube 113*a*, and the small-diameter piston 128 being stopped in contact with the stopper 129 of the large-diameter piston 127, with the pressure intensifying piston 123 is at the rear limit, stopped in contact with the rear cover 130.

At this stage, because the front supply/discharge path 118 and the rear supply/discharge path 119 are both connected to a tank and at a low pressure, the spools 131 and 132 are impelled by the springs 133 and 134, so that they are pressed up against the respective valve seats, so that the front valve 135 and the rear valve 126 are in the closed condition.

Therefore, the front main cylinder subchamber 115, the other-side pressure intensifying subchamber 122, and the rear main cylinder subchamber 116 are in the fluid locked condition, thereby fluidly limiting the movement of the main piston 117 and the pressure intensifying piston 123.

At this stage, the piston rod closes the die at the extension limit, and the piston rod 114 is fixed because of the above-noted fluid locked condition.

Next, when a selection valve connects the front supply/discharge path 118 to the fluid source and connects the rear supply/discharge path 119 to the tank, fluid at the set pressure at the fluid source side is supplied from the front supply/discharge path 118 via the second connection passageway 136 to the other-side cylinder subchamber 122, so that the pressure intensifying piston 123 is moved forward by the fluid pressure.

When this occurs, because the surface area of other side of the pressure intensifying piston 123 that receives the fluid pressure within the other-side pressure intensifying cylinder subchamber 122 (total surface area of the cylindrical portion 124 and the disc member 125) is quite a bit larger than the surface area of on the other side of the pressure intensifying piston 123 that receives the fluid pressure within the first pressure intensifying cylinder subchamber 120 (surface area of the cylindrical portion 124), the fluid within the first pressure intensifying cylinder subchamber 120 is compressed, so that a pressure considerably greater than the set pressure is developed.

The high-pressure fluid generated within the first pressure intensifying cylinder subchamber 120 is guided into the front main cylinder subchamber 115 via the first connection passageway 137, thereby applying a large fluid force that causes the main piston 117 to retract. Therefore, the large-diameter piston 127 and the small-diameter 128 that form the main piston 117 are moved rearward by a strong fluid force.

As a result, the die linked to the piston rod 114 is peeled away from the product by a large force, and opened.

When the above occurs, the fluid of the set pressure supplied to the front supply/discharge path 118 presses the spool 131 of the front value 135 so as to place the valve 135 in the open condition.

Additionally, the fluid of the set pressure is supplied via the front supply/discharge path 118, the second connection passageway 137, and the rear pilot passageway 138 to the pilot cylinder chamber 139, thereby pressing the pilot rod 140 of the pilot piston (82) so as to push in the spool 132, thereby opening the rear valve 126.

Therefore, fluid that flows out to the damper passageway (39) from the second pressure intensifying cylinder subchamber 121 and rear main cylinder subchamber 116 is discharged into the tank via the rear supply/discharge path 119.

In the above-noted condition, even if the pressure intensifying piston 123 moves to the forward limit, so that the front edge of its cylindrical part 124 stops in contact with the protruding part 141 of the cylinder casing 113, the large-diameter piston 127 and small-diameter piston 128 that form the main piston 117 continue to move rearward, so that the protruding part 142 of the large-diameter piston 127 makes contact with the protruding part 141 of the cylinder casing 113, thereby stopping its movement.

However, the small-diameter piston 128 is pressed by the fluid flowing into the large-diameter piston 127, and therefore continues to retract, until it makes contact with the stopper 143 provided at the rear part of the large-diameter piston 127 and stops.

When this occurs, pressure-receiving surface area of the small-diameter piston 127 is small and this piston moves at a higher speed than in the condition in which it was moving in concert with the large-diameter piston 127, so that it pulls in the piston rod 114 in a short period of time, thereby quickly lifting up the released die.

As noted above, the small-diameter piston 128 moves to the rear limit and stops, at which point the selection valve operates, so as to connect the rear supply/discharge path 119 to the tank, thereby causing the supply of fluid to stop, the result being that front valve 135 and the rear valve 126 are placed in the closed condition.

To extend the piston rod 114 and close the die, the switching valves are switched over, thereby connecting the front supply/discharge path 118 the tank and the rear supply/discharge path 119 to the fluid source.

As a result, the fluid from the fluid source is supplied via the rear supply/discharge path 119 and the damper passageway 144 to the rear main cylinder subchamber 116 and the second pressure intensifying cylinder subchamber 121 while pressing open the rear opening/closing valve 126, the fluid force acts to drive the main piston 117 forward, and fluid force acts so as to cause the pressure intensifying piston 123 to retract. When this occurs, a load is applied, this being the die having some weight linked to the main piston 117 via the piston rod 114. However, because no load is applied to the pressure-intensifying piston 123, the pressure-intensifying piston 123 moves to the other side in advance.

Further, at this moment, the fluid from the fluid source flows into the head-side subchamber of the pilot cylinder chamber 146 via the front pilot passageway 145, thereby opening the front opening/closing valve 135. As a result, the pressure intensifying piston 123 retracts, whereby a part of the fluid flowing into the second connection passageway 136 from the other-side pressure intensifying cylinder subchamber 122 then flows into the first pressure intensifying cylinder subchamber 120 via the front supply/discharge path 118, the front main cylinder subchamber 115 and the first connection passageway 137, the remainder of the fluid being discharged to the tank via the front supply/discharge path 118.

Subsequently the pressure intensifying piston 123 moves up to the other-side limit and comes into contact with the rear cover 130, at which the main piston 117 starts moving forward. Because of the relationship of contact surface areas, the small-diameter piston 128 moves first, and because the small-diameter piston 128 has a smaller area receiving pressure, it moves at a higher speed.

Then, when the small-diameter piston 128 comes into contact wit the stopper 129 of the large-diameter piston 127, these pistons move forward in concert, the main piston 117 reaching the forward limit, at which it stops, at which point a switching valve is switched so as to connect the front supply/discharge path 118 and the rear supply/discharge path 119 with the tank, thereby enabling the fluid locked condition with the die closed.

The above is the operating sequence of the fluid cylinder of Japanese Patent No. 2623075, during which process the cylinder chambers indicated as 150 and 161 in FIG. 13 also expand and contract, although there is absolutely no teaching therein of measures taken with respect to the increase and decrease of pressure of the cylinder chambers 150 and 151, which remains unclear.

In the above-described fluid cylinder according to the prior art, although there is indeed the achievement of a desired operation of a piston rod by a cylinder used for die drive in a die-cast machine or the like, as is clear from FIG. 13 as well, there is the need to form the complex passageways 118, 119, 136, and 137 within the cylinder casing 113 and the large-diameter piston 127 and, because the front opening/closing valve 135 and rear opening/closing valve 136 are substantially constitutional requirements for executing the above-noted operating sequence, it is also necessary to form the pilot passageways 138 and 145 within the cylinder case 113.

Therefore, it is necessary to make the wall thickness of the cylinder casing of the cylinder itself excessively thick and, because it is always important that this type of fluid cylinder be made small and light in order to build it into a die-casting machine, it was impossible to meet this requirement sufficiently.

Additionally, when a large number of flow paths are formed in the cylinder casing 113, for example, there is an inevitably large number of seal locations and, considering the need for this type of fluid cylinder to operate under severe conditions of high temperature and high pressure, this fact alone brings with it the problem of a commensurate increase in failures other problems and a decrease in reliability.

Additionally, while the front opening/closing valve 135 and rear opening/closing valve 126 are provided externally at the front and rear port parts, this results in a commensurate increase in the number of components, thereby aggravating the above-noted problems, while raising the number of forming steps and leading to an increase the cost of manufacture.

Accordingly, it is an object of the present invention to provide a cylinder apparatus with a fluid cylinder for use in die drive, having an extremely simple configuration, while providing a structure that stably executes the above-noted desired operational sequence, thereby solving the above-noted problems.

SUMMARY OF THE INVENTION

To achieve the above-noted objects, the present invention is a cylinder apparatus having a configuration with an overall outer appearance of having a single-rod cylinder, an annular protruding zone formed at an intermediate position in the longitudinal direction of the inner peripheral surface of a cylinder tube providing division into a front cylinder chamber and a rear cylinder chamber, an annular disc part of the front cylinder chamber being fitted into the front cylinder chamber and a annular tube part being fitted into the protruding zone, an operating piston rod being fitted into a hole formed in the center of the annular disc part, rotation within the cylinder tube being restricted by a rotation-stopping mechanism, and a valve opening/closing bar being provided upright on a surface of a rod cover side of the annular disc part, the annular disc part being fitted into the cylinder chamber of the rear cylinder chamber, and fitted loosely into the annular tube part of the primary side piston, with a gap therebetween. The internal peripheral surface of an inward-facing flange formed on the inside of the front end of the annular tube part has the rod of the operating piston rod loosely fit therewithin with a gap therebetween, and on a common internal peripherial surface of the annular disc part and the annular tube part, a secondary side piston is provided and fit within the piston of the operating piston rod. Because the cylinder tube has formed on it a protruding zone, the cylinder chamber formed by the internal peripheral surface of the cylinder tube, the annular disc part of the primary side piston, and the annular tube part is either made an air chamber that communicates with the outside, or a fluid cylinder chamber that is connected at all times to the drain side, a fluid path being formed by communication between the cylinder chamber on the rod cover side from the primary-side piston in the front cylinder chamber and the cylinder chamber enclosed by the internal peripheral surface of the cylinder tube and the end surfaces of the secondary-side piston disc part and annular tube part and primary-side piston annular tube part, by means of a relief valve therebetween, this relief valve being changed from the closed condition to the open condition either by a prescribed fluid pressure or by a mechanical force from the valve opening/closing bar of the primary-side piston.

At the extension step, in which the front port is placed in the drain condition and in which fluid is supplied from the rear port, because the relief valve is in the closed condition, the primary-side piston in the present invention moves forward, by the movement of fluid in response to the forward movement of the secondary-side piston and the operating piston.

At the point at which the extension step is completed, the valve opening/closing bar provided on the primary-side piston switches the relief valve from the closed condition to the open condition, and at the beginning of the retraction step, the rear port is placed in the drain condition and fluid is supplied from the front port, fluid pressure acts on the mutually engaged operating piston and secondary-side piston via the communication path, so that retraction of the engaged pistons is made by a large driving force through a short zone only.

That is, the primary-side piston serves the function of adaptively controlling the relief valve by means of the valve opening/closing bar, and at the beginning of the retraction step the secondary-side piston, in the condition in which it has become engaged with the operating piston that receives a large load, has a large pressure-receiving surface area, and serves the function of intensifying pressure.

In addition to mechanical control of the relief valve by the valve opening/closing bar, the relief valve also goes into the open condition when it receives a prescribed pressure, the switching of this valve between the open condition and the closed condition blocking and opening the communication flow path, thereby adaptively operating the primary-side piston and the secondary-side piston, the result being that during a certain zone only in at the start of the retraction step, drive is applied with a strong force, and at other stages high-speed drive is applied.

The provision of a rotation-stopping mechanism for the primary-side piston is done to assure that the valve opening/closing bar is always in opposition to the relief valve. The actual configuration of this mechanism is one in which a seal mechanism is provided on the inner peripheral surface of a through hole formed in a region other than the rod cover passage hole in the rod cover, an operation verification bar that is provided upright on a surface on the rod cover side of the annular primary-side piston being fitted into the above-noted passage hole, and over the entire stroke zone of the primary-side piston within the front cylinder chamber, it is possible for the operation verification bar to slide in the condition of fitting within the passage hole, in which case this also has the function of verifying the operation of the primary-side piston.

The cylinder chamber formed by the inner peripheral surface of the cylinder tube, the annular disc part of the primary-side piston, and the annular tube expands and contracts by the movement of the primary-side piston, and when this cylinder chamber is made an air chamber communicating with the outside or filled with fluid, if the drain connection condition is made (it being generally simple to make it an air chamber), there is absolutely no influence on the movement of the primary-side piston.

The above-noted operation verification mechanism can be added in the same manner to the relationship between the secondary side piston and head cover, in which case it is easy to verify the operating condition of the secondary side piston from the outside.

BRIEF DESCRIPTION OF THE ACCOMPANYING DRAWINGS

DETAILED DESCRIPTION OF THE PREFERRED EMBODIMENTS

An embodiment of a cylinder apparatus according to the present invention are described in detail below, with reference made to FIG. 1 through FIG. 12.

Figure 1:
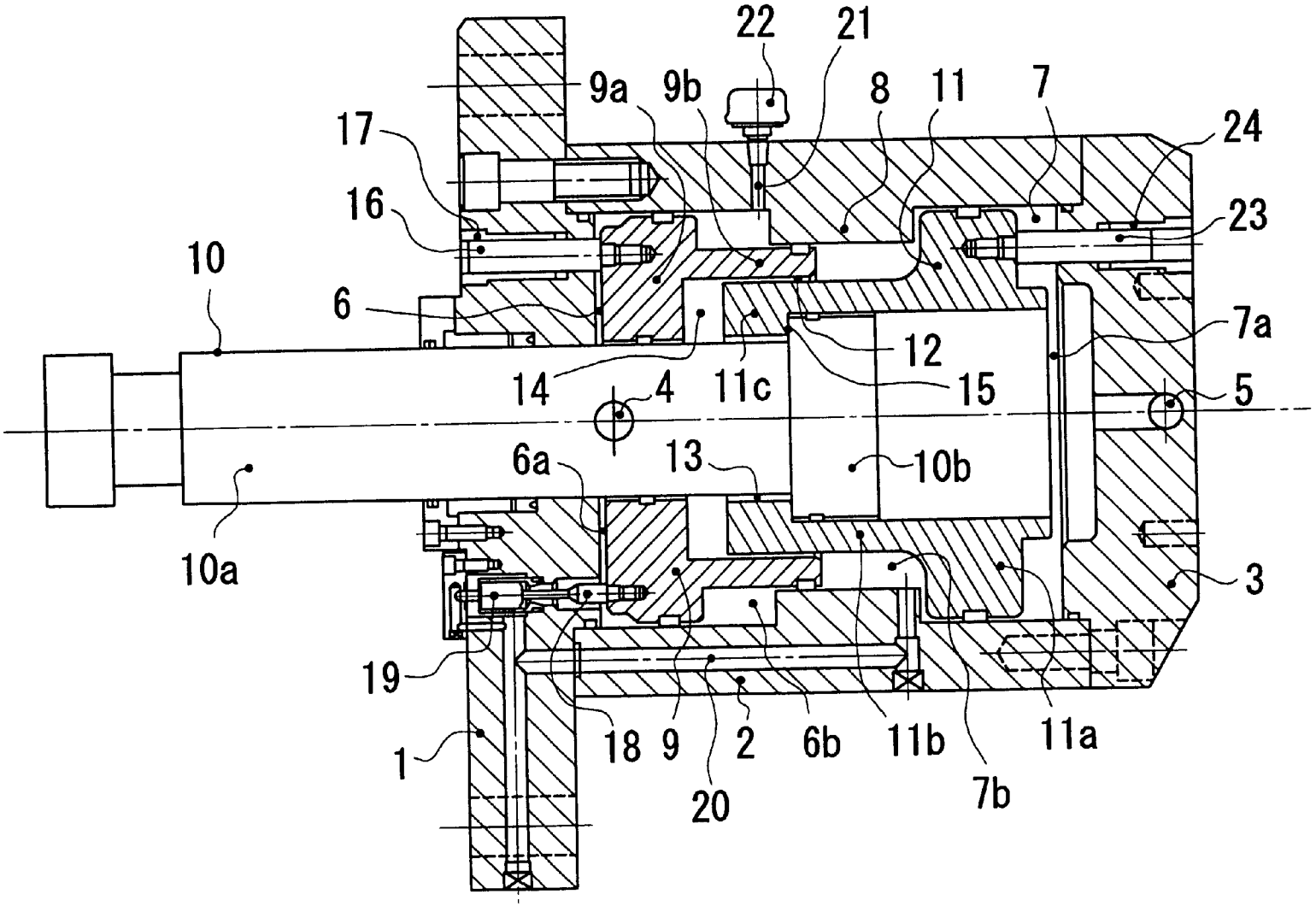
FIG. 1 is a cross-section view of a cylinder apparatus according to an embodiment of the present invention.
Figure 2:
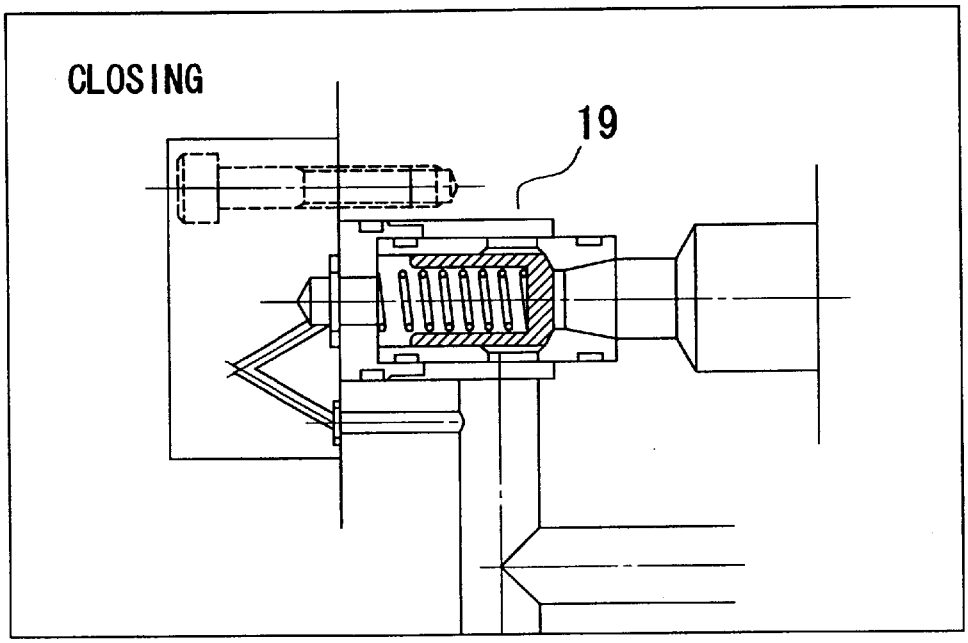
FIG. 2 is an enlarged cross-section view showing a relief valve in the closed condition.
Figure 3:
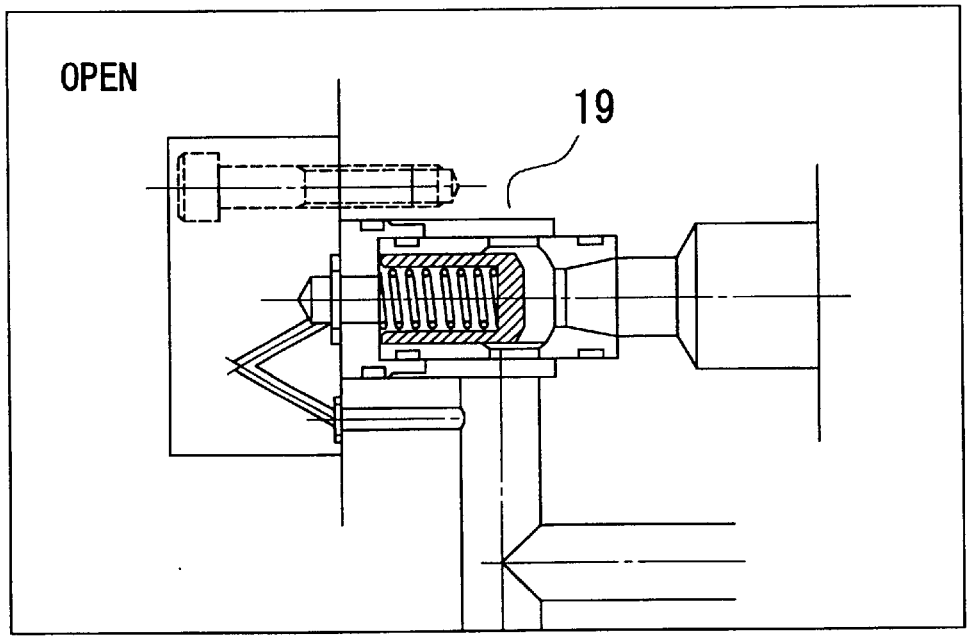
FIG. 3 is an enlarged cross-section view showing a relief valve in the open condition.

The configuration of the cylinder apparatus according to this embodiment is shown in FIG. 1.

This cylinder apparatus is one which externally appears as a single-rod cylinder, wherein a rod cover flange 1, a cylinder tube 2, and a head cover 3 form the main unit, and one port 4 is provided in the vicinity of the rod cover flange 1 in the cylinder tube 2, and the other port 5 is provided on the side surface of the head cover 5. The port 4 communicates with the a front cylinder chamber 6 via a passage that passes through the cylinder tube 2, and the port 5 communicates with the rear cylinder chamber 7 via a passage formed within the head cover 3.

An annular protruding zone 8 is formed midway in the longitudinal direction on the inner peripheral surface of the cylinder tube 2, thereby defining the front cylinder chamber 6, which is to the front of the protruding zone 8 in the cylinder tube, and the rear cylinder chamber 7, which is to the rear of the protruding zone 8.

A primary-side piston 9, formed by an annular disc part 9*a* and an annular tube part 9*b*, is provided within the front cylinder chamber 2 of the cylinder tube 2. The annular disc part 9*a* is fitted within the front cylinder chamber 6 forming the front part defined by the protruding zone 8, with piston packing therebetween, a rod 10*a* of an operating piston 10 passing through the center part thereof, with piston packing therebetween. The annular tube part 9*b* is fitted within the protruding zone 8 with piston packing therebetween, and the axial-direction length thereof is established as being shorter than the axial-direction length of the protruding zone 8.

Therefore, by the annular disc part 9*a* of the primary-side piston 9, the front cylinder chamber 6 is divided between a first front cylinder chamber 6*a* formed between the rod cover flange 1 and the annular disc part 9*a*, and a second font cylinder chamber 6*b* formed between the protruding zone 8 and the annular disc part 9*a*.

A secondary side piston 11, formed by an annular disc part 11*a* and an annular tube part 11*b*, is provided within the rear cylinder chamber 7 side of the cylinder tube 2. The annular disc part 11*a* is fitted into the rear cylinder chamber 7 to the rear of the protruding zone 8, with piston packing therebetween, and the annular tube part 11*b* is loosely fitted into the annular tube part 9*b* in the primary-side piston 9, with a gap 12 therebetween, an operating piston 10*b* of the operating piston 10 being fitted into the common internal peripheral surface of the annular disc part 11*a* and the annular tube part 11*b*. An inward-facing flange 11*c* is formed on the front end of the annular tube part 11*b*, the hole of this inward-facing flange 11*c* allowing the rod 10*a* of the operating piston 10 to pass therethrough, with a gap 13 therebetween.

Therefore, by the annular disc part 11*a* of the secondary side piston 11, the rear cylinder chamber 7 is divided between a first rear cylinder chamber 7*a* formed between the head cover 3 and the annular disc part 11*a* , and a second rear cylinder chamber 7*b* formed between the rear end surfaces of the protruding zone 8 and the annular tube part 9*b* of the primary-side piston 9.

Because the annular tube part 11*b* is loosely fitted into the annular tube part 9*b* of the primary-side piston 9 as noted above, a first intermediate cylinder chamber 14 is formed between the inward-facing flange 11*c* and the annular disc part 9*a* of the primary-side piston 9, and because the operating piston 10*b* is fitted inside the common internal peripheral surface of the annular disc part 11*a* and the annular tube part 11*b*, a second intermediate cylinder chamber 15 is formed between the inward-facing flange 11*c* and the operating piston 10*b*. The second rear cylinder chamber 7*b* communicates at all times with and the first intermediate cylinder chamber 14 via the gap 12, and the first intermediate cylinder chamber 14 communicates at all times with the second intermediate cylinder chamber 15 via the gap 13.

A mechanism described below is provided between the primary-side piston 9 and the rod cover flange 1. First, an operation verification bar 16 is provided perpendicularly upright on the front surface of the primary-side 9, and a bushing 17 is buried from the outside at a position corresponding to the operation verification bar 16 on the rod cover flange 1, thereby forming a hole in which packing is fixed to the internal peripheral surface, so that in the step in which the annular disc part 9*a* of the primary-side piston 9 is reciprocating between the rod cover flange 1 and the protruding zone 8 of the cylinder tube 2, because the operation verification bar 16 is fitted within the above-noted hole, in addition to preventing the rotation of the primary-side piston 9, it is possible to verify the operation of the primary-side piston 9.

A valve opening/closing bar 18 is fixed upright on the front surface of the primary-side piston 9, and a relief valve 19 is buried at a position corresponding to the valve opening/closing bar 18 on the rod cover flange 1, so that when the first front cylinder chamber 6*a* reaches a prescribed pressure (Lp), there is a switching of this relief valve 18 from the closed condition to the open condition, and also when the primary-side piston 9 moves forward and the valve opening/closing bar 18 mechanically applies a force to the spool of the relief valve 19, the relief valve 19 is switched from the closed condition to the open condition. The configuration of the relief valve 19 is shown in the closed and open conditions in FIG. 2 and FIG. 3, respectively.

The relief valve 19 is disposed midway in a communicating passageway 20 formed within the rod cover flange 1 and the cylinder tube 2, this communicating passageway 20 being a circuit that connects the inside surface of the rod cover flange 1 with an aperture formed on the rear end of the protruding zone 8 in the cylinder tube 2, the result of which is that the relief valve 19 serves the function of switching between communicating and non-communicating between the first front cylinder chamber 6*a* and the second rear cylinder chamber 7*b*.

Additionally, a hole 21 is provided at a part immediately forward of the protruding zone 8 in the cylinder tube 2, this hole 21 being connected to an air breather 22 provided in the cylinder tube 2. Thus, in contrast to the other cylinder chambers that are oil chambers, the second front cylinder chamber 6*b* is an air chamber, which is always maintained at atmospheric pressure, and when air flows in, dust and the like are prevented from intruding, by the filtering function of the air breather 22.

Between the secondary-side piston 11 and the head cover 3 as well, similar to between primary-side piston 9 and the rod cover flange 1, there is provided the following type of mechanism. Specifically, an operation verification bar 23 is provided perpendicularly upright on the rear surface of the secondary-side piston 11, and a bushing 24 is buried from the outside at a position corresponding to the operation verification bar 23 on the head cover 3, thereby forming a hole in which packing is fixed to the internal peripheral surface, so that in the step in which the annular disc part 11*a* of the secondary-side piston 11 is reciprocating between the head cover 3 and the protruding zone 8 of the cylinder tube 2, because the operation verification bar 23 is fitted within the above-noted hole, it is possible to verify the operating condition of the secondary-side piston 11.

Next, the operating conditions of the above-described cylinder apparatus will be described for each operating step, with references being made to FIG. 4 through FIG. 12.

Figure 4:
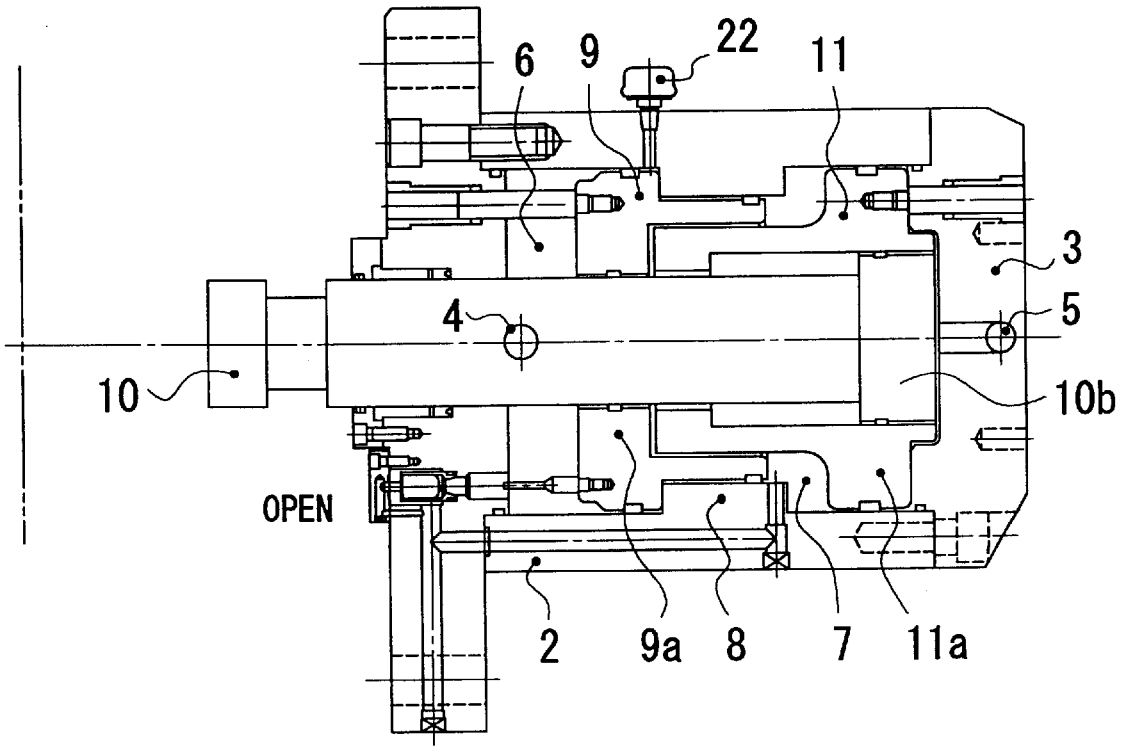
FIG. 4 is a cross-section view showing the operating condition (retracted to the maximum limit) at the first stage of the cylinder apparatus according to an embodiment of the present invention.

Step 1 (Refer to FIG. 4)

At this step, the operating piston rod 10 is retracted to the maximum limit, and the primary-side piston and secondary-side piston 11 are also at the maximum rear limit in the front cylinder chamber 6 and rear cylinder chamber 7.

That is, the operating piston 10*b* of the operating piston rod 10 is in contact with the head cover 3, and the annular disc part 9*a* of the primary-side piston 9 in contact with the front end surface of the protruding zone 8 of the cylinder tube 2, the annular disc part 11*a* of the secondary-side piston 11 makes contact with the head cover 3.

Figure 5:
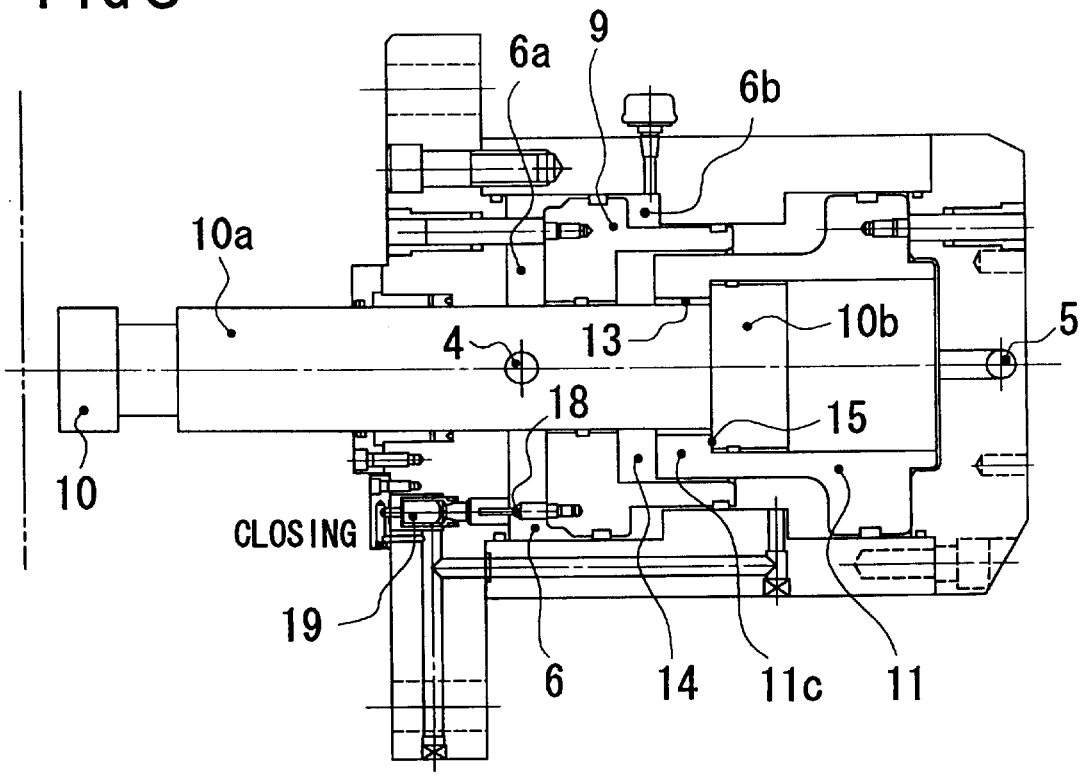
FIG. 5 is a cross-section view showing the operating condition beginning of extension) at the first stage of the cylinder apparatus according to an embodiment of the present invention.

Step 2 (Refer to FIG. 5)

At this step, with the port 4 in the drain condition and fluid being supplied from the port 5, first the operating piston 10*b* is pressed forward, so that the operating piston rod 10 starts to move forward, in which the fluid in the second intermediate cylinder chamber 15 passes via the gap 13 formed between the rod 10*a* and the inward-facing flange 11*c* of the secondary-side piston 11 and flows into the first intermediate cylinder chamber 14, so that the primary-side piston 9 is driven forward.

Then, in this condition, because the first front cylinder chamber 9*a* is in drain condition and the second front cylinder chamber 6*b* is maintained at atmospheric pressure, the primary-side piston 9 moves smoothly forward within the front cylinder chamber 6.

As a result, the operating piston 10*b* moves forward until it makes contact with the inward-facing flange 11*c* of the secondary-side piston 11, the and primary-side piston 9 moves forward in response to the amount of flow of fluid into the first intermediate cylinder chamber 14.

At this step, the valve opening/closing bar 18 of the primary-side piston 9 has not yet reached the relief valve 19, so that the relief valve 19 remains in the closed condition.

Figure 6:
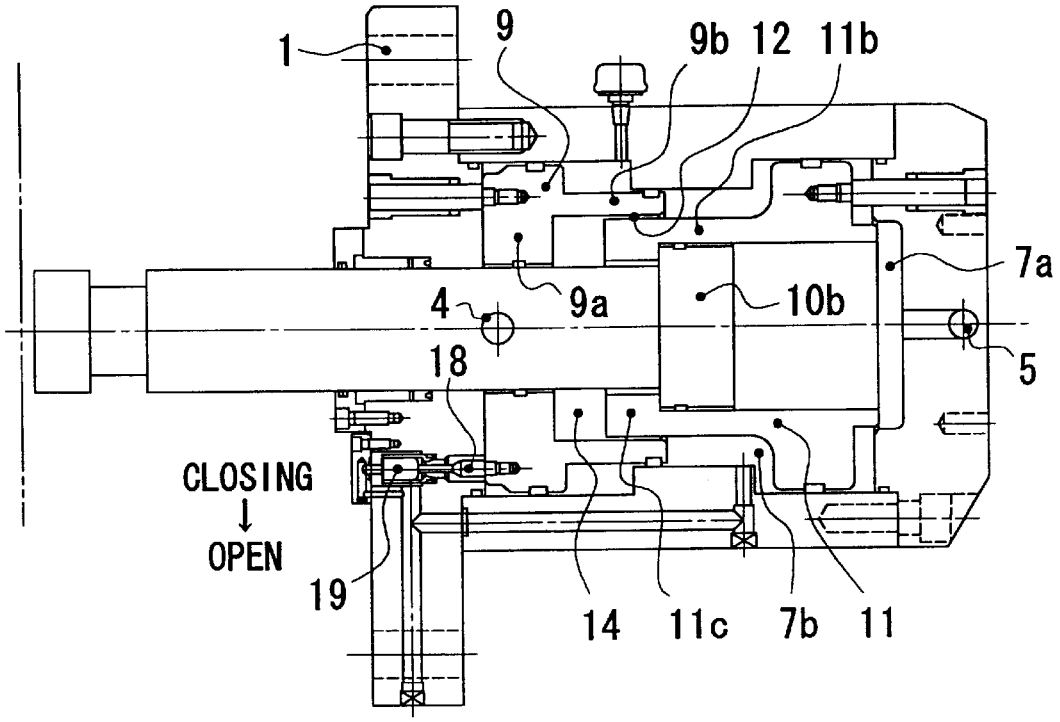
FIG. 6 is a cross-section view showing the operating condition (continuation of extension) at the first stage of the cylinder apparatus according to an embodiment of the present invention.

Step 3 (Refer to FIG. 6)

At the above-noted step 2, with the operating piston 10*b* in contact with the inward-facing flange 11*c* of the secondary-side piston 11, when the supply of fluid from the port 5 continues, the fluid flowing into the first intermediate cylinder chamber 7*a* pushes the entire secondary-side piston 11, which is engaged with the operating piston 10*b*, forward, thereby causing the secondary-side piston 11 to move forward.

When the above occurs, because the relief valve 19 is in the closed condition, the fluid in the second cylinder chamber 7*b* passes via the passageway formed between the annular tube part 9*b* of the primary-side piston 9 and the annular tube part 11*b* of the secondary-side piston 11 so as to flow into the first intermediate cylinder chamber 14, thereby causing the primary-side piston 9 to move further forward.

Figure 7:
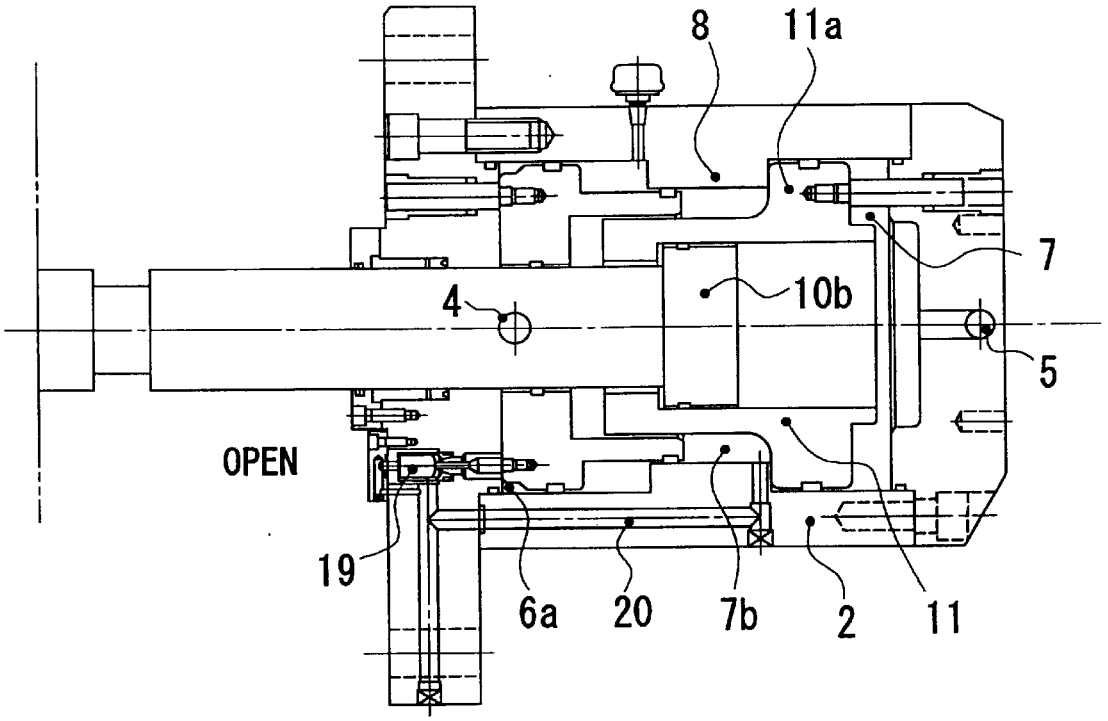
FIG. 7 is a cross-section view showing the operating condition (extension completed) at the first stage of the cylinder apparatus according to an embodiment of the present invention.

As a result, the primary-side piston 9 moves forward up to a position at which the annular disc part 9*a* of the primary-side piston 9 makes contact with the rod cover flange 1, but immediately before coming into contact therewith, the valve opening/closing bar 18 places the relief valve 19 in the open condition Step 4 (Refer to FIG. 7)

Even if the third step is completed, although the annular disc part 11*a* of the secondary-side piston 11 is still midway in the rear cylinder chamber 7, because the relief valve 19 is in the open condition, the second rear cylinder chamber 7*b* is in the drain condition. That is, there is communication between the second rear cylinder chamber 7*b*, the communicating passageway 20, the relief valve 19, and the first forward cylinder chamber 6*a*, with the port 4 in the drain condition, so that the second rear cylinder chamber 7*b* is also in the drain condition.

Therefore, when the supply of fluid from the port 5 continues, the secondary-side piston 11 moves forward in the engaged condition with the operating piston 10*b* up to a position at which the annular disc part 11*a* thereof comes into contact wit the rear end surface of the protruding zone 8 of the cylinder tube 2, and the rod extension step is completed in this condition.

Then, in this condition, when the valve provided in the fluid supply path with respect to the ports 4 and 5 is blocked, because piston packing creates a sealed condition between the cylinder tube 2 and the secondary-side piston 11, and between the secondary-side piston 11 and the operating piston 10*b*, the operating piston 10 is in a fluid-locked condition. That is, the configuration is one in which there is a completely fixed condition, with the die closed.

Figure 8:
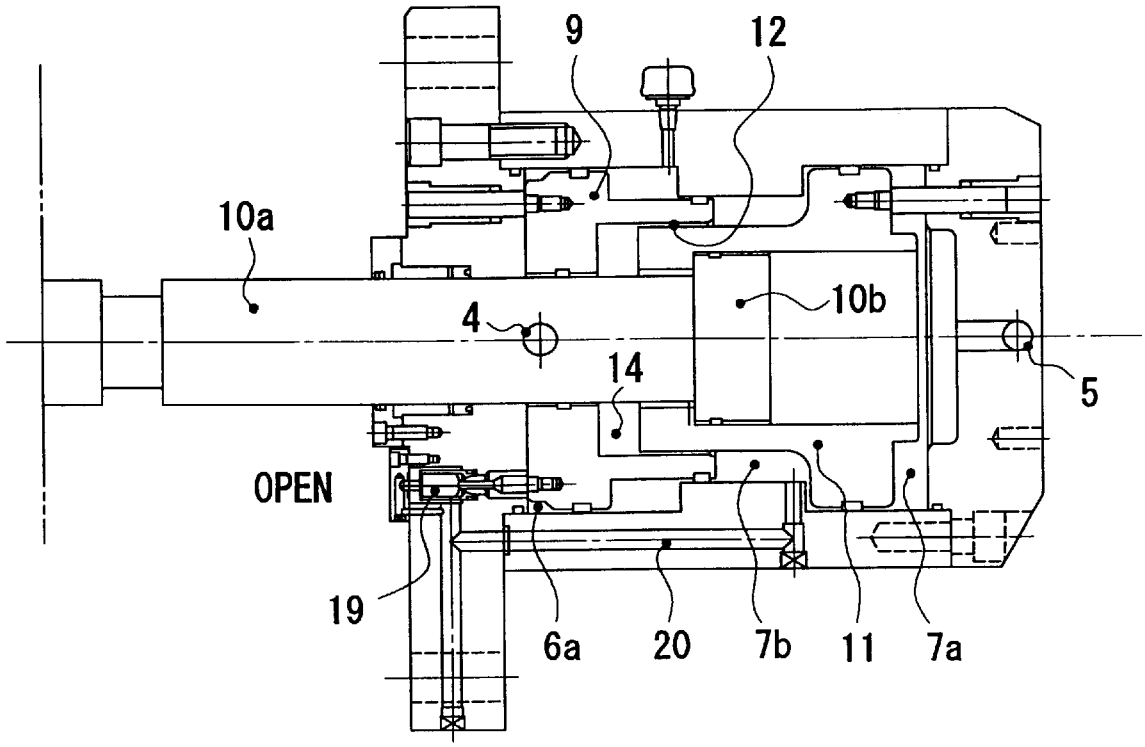
FIG. 8 is a cross-section view showing the operating condition (beginning of retraction) at the first stage of the cylinder apparatus according to an embodiment of the present invention.

Step 5 (Refer to FIG. 8)

When a prescribed task is completed after the above-noted extension step in the fluid-locked condition, the fluid supply condition is caused to reverse, the port 4 being placed in the supply condition, and the port 5 being placed in the drain condition, thereby starting the retraction step.

At this point, however, because the die is to be peeled away from the workpiece, a large load is applied to the retraction of the rod 10*a*.

When the fluid flow is reversed, because the relief valve 19 is in the open condition, as described with regard to step 4, there is communication between the first front cylinder chamber 6*a*, the relief valve 19, the communicating passageway 20, an the second rear cylinder chamber 7*b*, so that force is applied by virtue of fluid supplied to the first intermediate cylinder chamber 14, via the first cylinder chamber 6*a*, the second rear cylinder chamber 7*b*, and the gap 12.

In the above-noted condition, in contrast to primary-side piston 9 is in a reverse-direction pressure-receiving condition from the first front cylinder chamber 6*a* and the first intermediate cylinder chamber 14, the engaged secondary-side piston 11 and operating piston 10*b* receive rearward pressure from the first intermediate cylinder chamber 14 and the second rear cylinder chamber 7*b*, and the first rear cylinder chamber 7*a* is in the drain condition.

Therefore, the engaged secondary-side piston 11 and operating piston 10*b* resist the high load applied to the rod 10*a* and receive a large rearward force and are moved rearward over only a short zone. That is, a large driving force acts to move the engaged pistons 11 and 10*b* rearward only at the step of opening the die linked to the rod 10*a*.

Figure 9:
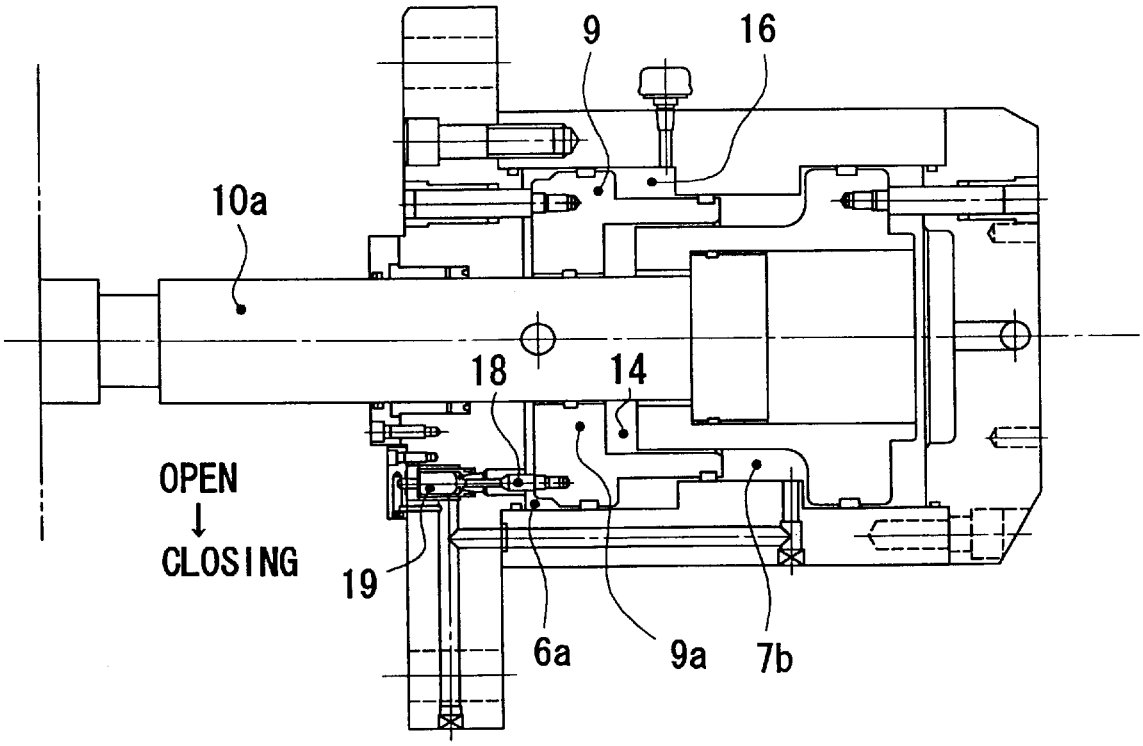
FIG. 9 is a cross-section view showing the operating condition (continuation of retraction) at the first stage of the cylinder apparatus according to an embodiment of the present invention.

Step 6 (Refer to FIG. 9)

At the above-noted step 5, when retraction is done over only the short zone, because the die is peeled away from the product, there is a sudden decrease in the load applied to the rod 10*a*.

At the above-noted point, the pressure-receiving condition of the primary-side piston 9, with the relief valve 19 in the open condition and the pressure of the first intermediate cylinder chamber 14 and the second rear cylinder chamber 7*b* is reduced, the pressure of the first front cylinder chamber 6*a* becoming the same pressure, although the pressure-receiving surface area of the front cylinder chamber 6*a* is larger.

At this step, therefore, the primary-side piston 9 also starts to move rearward, and accompanying this movement the valve opening/closing bar 18 retracts, thereby switching the relief valve 19 from the open condition to the closed condition. When this occurs, because the second front cylinder chamber 6*b* is always maintained at atmospheric pressure, the primary-side piston 9 movement is not hindered.

Figure 10:
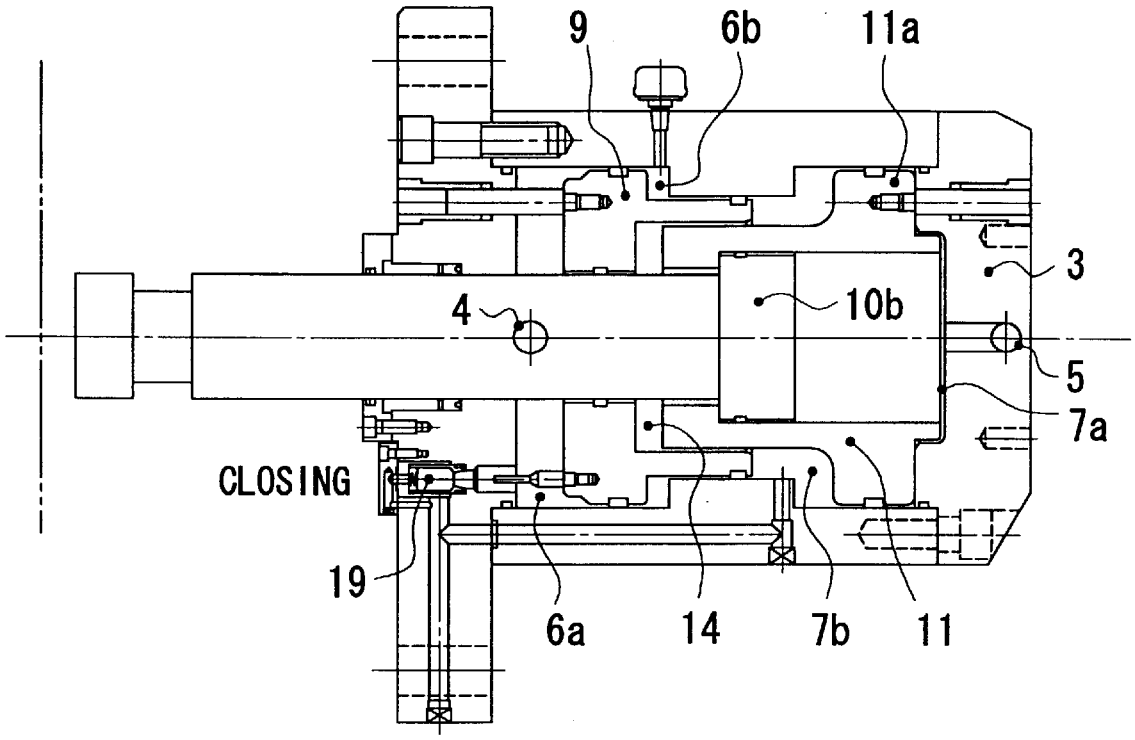
FIG. 10 is a cross-section view showing the operating condition (continuation of retraction) at the first stage of the cylinder apparatus according to an embodiment of the present invention.

Step 7 (Refer to FIG. 10)

When at the above-noted step 6 the relief valve is closed, there is no fluid supply pressure to the first intermediate cylinder chamber 14 and the second rear cylinder chamber 7*b* from the port 4, fluid pressure being applied only to the first front cylinder chamber 7*a*.

The primary-side piston, therefore, moves further rearward, the engaged secondary-side piston 11 and operating piston 10*b* being caused to move rearward by the fluid of the first intermediate cylinder chamber 14 and second rear cylinder chamber 7*b* that are closed off by means of the relief valve 19 closed condition, so that the annular disc part 11*a* of the secondary-side piston 11 moves rearward in this condition until in comes into contact with the head cover 3. The rod 10*a* is retracted at the speed of movement of the primary-side piston 9, which is responsive to the amount of fluid supplied from the port 4 to the first cylinder chamber 6*a*.

At this step as well, the second front cylinder chamber 6*b* is maintained at atmospheric pressure at all times, and movement of the primary-side piston 9 is not hindered.

Figure 11:
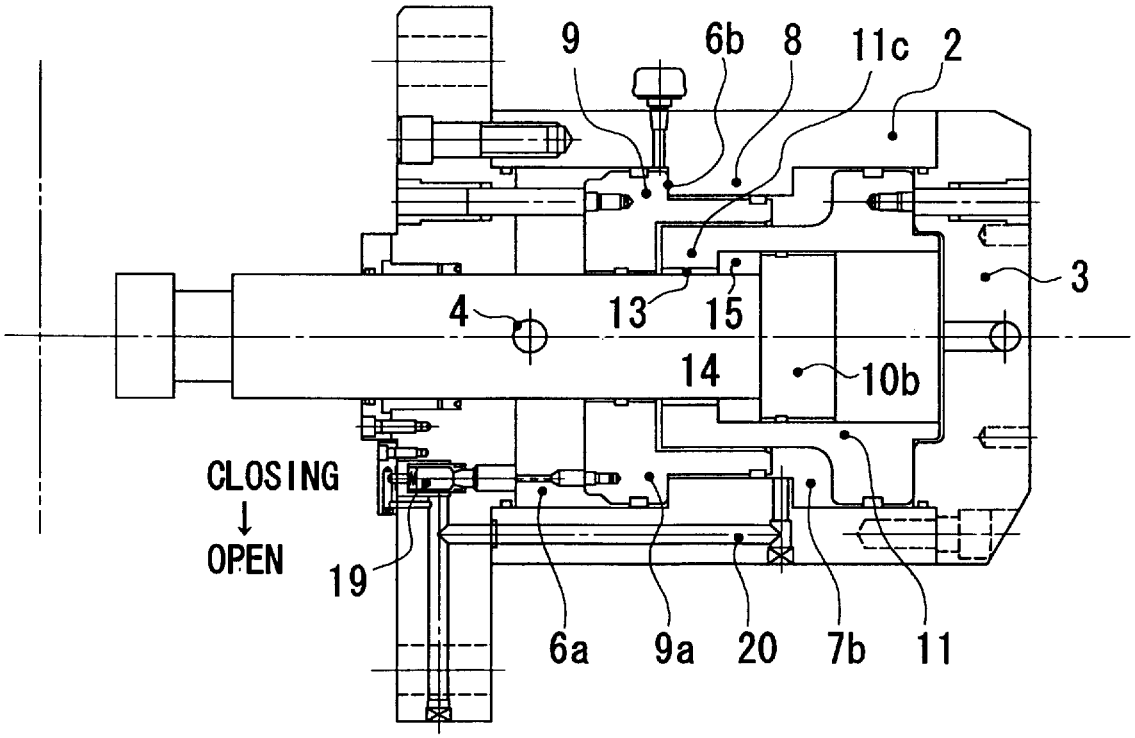
FIG. 11 is a cross-section view showing the operating condition (continuation of retraction) at the first stage of the cylinder apparatus according to an embodiment of the present invention.

Step 8 (Refer to FIG. 11)

At the above-noted step 7, after the secondary-side piston 11 comes into contact with the head cover 3, when the fluid supply from the port 4 is continued, because the relief valve 19 is in the closed condition, the pressure in the first intermediate cylinder chamber 14 and the second rear cylinder chamber 7*b* rises, the movement of the primary-side piston 9 is restricted, and there is an inevitable increase in pressure in the first front cylinder chamber 6*a*.

Then, when the pressure of the first front cylinder chamber 6*a* reaches the setting pressure Lp of the relief valve 19, the relief valve 19 is switched from the closed condition to the open condition.

As a result, there is communication between the first front cylinder chamber 6*a*, the first intermediate cylinder chamber 14, and the second rear cylinder chamber 7*b*, but because the pressure-receiving surface area of the primary-side piston 9 is larger than that of the first front cylinder chamber 6*a*, the primary-side piston 9 moves rearward until it reaches a position at which the annular disc part 9*a* thereof comes into contact with the front end surface of the protruding zone 8 of the cylinder tube 2. In this case as well, the second front cylinder chamber 6*b* is at atmospheric pressure, and there is no hindrance to the movement of the primary-side piston 9.

When the primary-side piston 9 comes into contact with the front-end surface of the protruding zone 8, although the primary-side piston 9 cannot be retracted further, the supply of fluid from the port 4 continues.

The relief valve 19 is maintained in the open condition, and the supplied fluid passes inevitably via the communicating passageway 20 from the second rear cylinder chamber 7*b* to flow into the first intermediate cylinder chamber 14. Because the secondary-side piston 11 has already at step 7 come into contact with the head cover 3, it cannot move rearward, and the fluid that flows into the first intermediate cylinder chamber 14 flows passes via the gap between the road 10*a* and the inward-facing flange 11*c* of the secondary-side piston 11 and flows into the second intermediate cylinder chamber 15, thereby pushing the operating piston 10*b* rearward.

The operating piston 10*b* is therefore released from its engagement with the secondary-side piston 11 and starts to move rearward.

Figure 12:
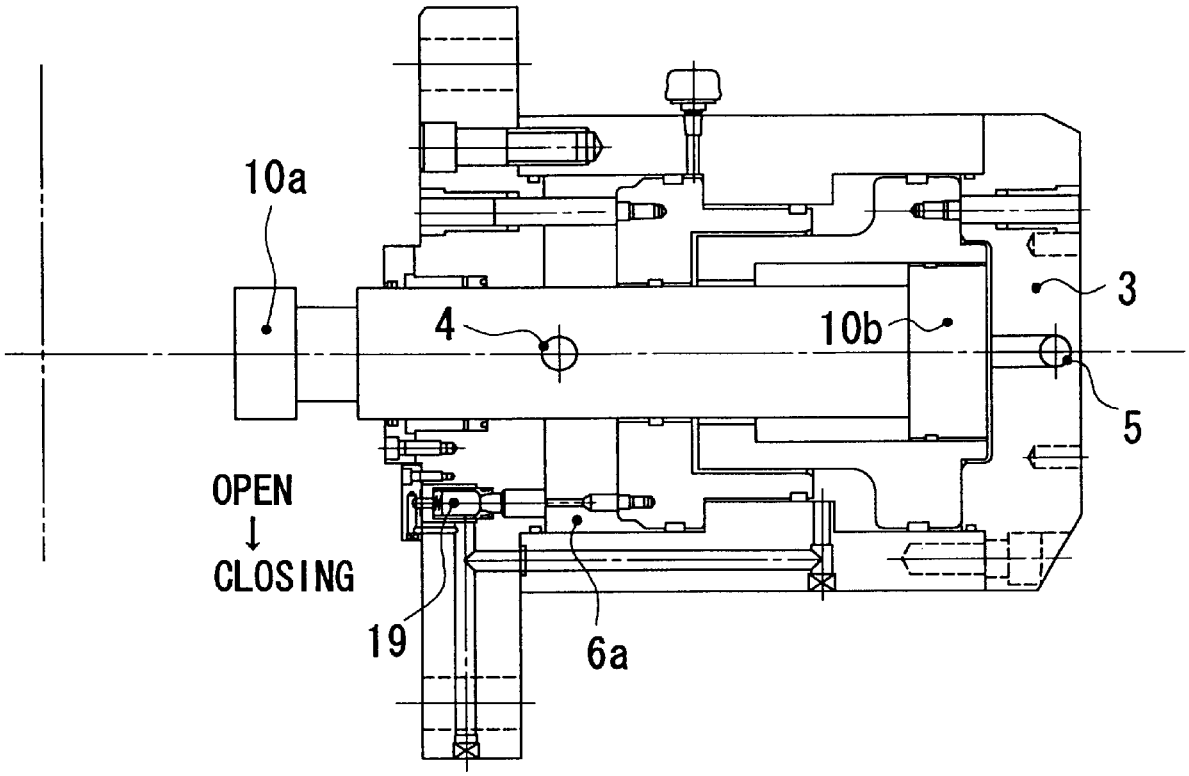
FIG. 12 is a cross-section view showing the operating condition (retraction completed) at the first stage of the cylinder apparatus according to an embodiment of the present invention.
Figure 13:
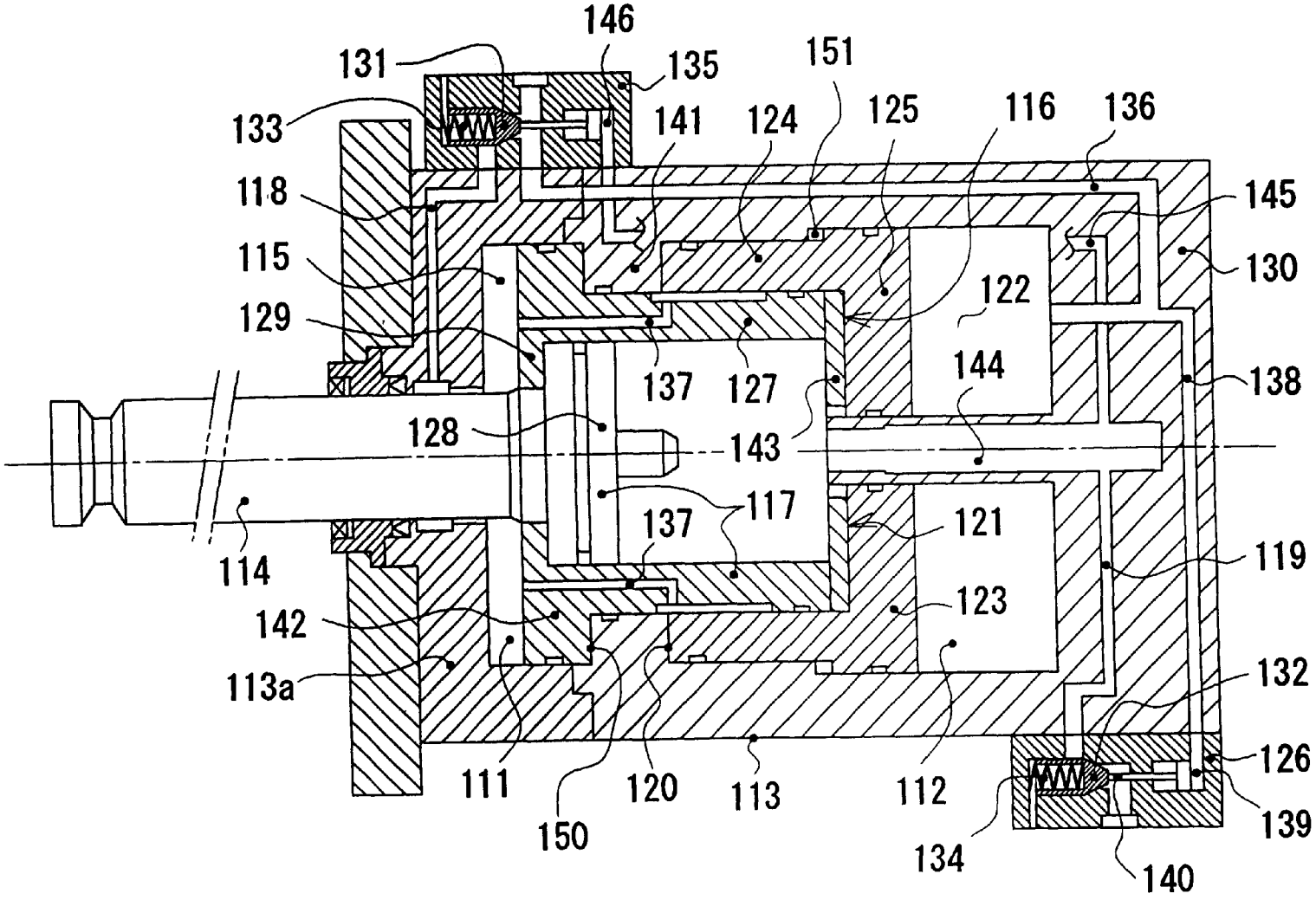
FIG. 13 is a cross-section view showing a fluid cylinder of prior art in Japanese Patent No. 2623075.

Step 9 (Refer to FIG. 12)

When the supply of fluid from the port 4 continues further after the above-noted step 8, the operating piston 10*b* moves rearwards until it makes contact with the head cover 3, with the relief valve 19 remaining in the open condition, and in this condition the supply of fluid from the port 4 is stopped, and switching is made to the drain condition. That is, the rod

10*a* moves quickly to the maximum retracted limit, and the pressure of the first forward cylinder chamber 6*a* becomes smaller than the setting pressure (Lp) of the relief valve 19, so that the relief valve 19 is switched from the open condition to the closed condition.

As a result, return is made to the initial condition of step 1, from which, with the port 4 placed in the drain condition again, if supply of fluid is made from the port 5, the above steps are repeatedly executed. In general, however, once return is made to the initial condition, valves provided in the fluid supply paths to the ports 4 and 5 are first shut off, after which drain settings are made for the ports 4 and 5.

It is easy to verify the operation of the operation verification bars 16 and 23 from the outside, and possible to verify the operating conditions of the primary-side piston 9 and the secondary-side piston 11, so that it a problem occurs, it is possible to know the cause, thereby facilitating maintenance.

According to the cylinder apparatus described above, it is possible with just selection control of the fluid supply from the ports 4 and 5 to supply a large driving force at only the start of retraction of the rod 10*a*, and to achieve quick operation of the rod 10*a* at the extension and other steps than the above-noted step, this being done with an apparatus having a simple configuration, which requires for control only one communicating passageway with an intervening bypass path and relief valve, thereby not only enabling the compact, lightweight apparatus, but also enabling stable operation at all times.

By adopting the constitution described above in detail, a cylinder apparatus according to the present invention achieves a number of effects.

The first aspect of the present invention, as recited in claim 1 of the accompanying claims, supplies a large driving force at only the start of the retraction of the rod 10*a* and quick operation of the rod 10*a* during extension and other steps, doing this with a simple configuration, thereby enabling a reduction in the size and weight of a die-driving cylinder for use with a die-cast machine, injection molding machine, or the like.

Using a simplified configuration, it is possible to achieve stable operation at all times, and to provide a cylinder apparatus with high reliability.

The second aspect of the present invention, as recited in claim 2 of the accompanying claims, while it requires restriction of the rotation of the primary-side piston to assure proper actuation of the relief valve by the valve opening/closing bar, enables that restriction mechanism to be implemented in conjunction with the primary-side piston operation verification mechanism.

The third aspect of the present invention, as recited in claim 3 of the accompanying claims, by providing an operation verification mechanism for the secondary-side piston, verification of the operation of not only the primary-side piston but of all internal operation from outside, thereby facilitating the identification and correction of the causes of faulty operation.

What is claimed is:

1. A cylinder apparatus having a configuration with an overall outer appearance of having a single-rod cylinder, comprising:

a cylinder tube, with an annular protruding zone formed at an intermediate position therein in the longitudinal direction of an inner peripheral surface thereof, providing division into a front cylinder chamber and a rear cylinder chamber, an annular disc part in the front cylinder chamber fitted into said front cylinder chamber and a annular tube part being fitted into the protruding zone;

an operating piston rod fitted into a hole formed in the center of said annular disc part;

a rotation-stopping mechanism that stops rotation within cylinder tube; and a valve opening/closing bar, provided upright on a surface of a rod cover side of said annular disc part, said annular disc part being fitted into said cylinder chamber of said rear cylinder chamber, and fitted loosely into said annular tube part of said primary-side piston, with a gap therebetween, wherein an internal peripheral surface of an inward-facing flange formed on the inside of said front end of the annular tube part has a rod of said operating piston rod loosely fit therewithin with a gap therebetween, on a common internal peripherial surface of said annular disc part and said annular tube part, a secondary side piston is provided and fit within the piston of the operating piston rod, because the cylinder tube has formed on it a protruding zone, said cylinder chamber formed by the internal peripheral surface of the cylinder tube, the annular disc part of the primary side piston, and the annular tube part is either made an air chamber that communicates with the outside, or a fluid cylinder chamber that is connected at all times to the drain side, a fluid path being formed by communication between said cylinder chamber on said rod cover side from said primary-side piston in said front cylinder chamber and said cylinder chamber enclosed by said internal peripheral surface of said cylinder tube and the end surfaces of said secondary-side piston disc part and annular tube part and primary-side piston annular tube part, by means of a relief valve therebetween, said relief valve being changed from the closed condition to the open condition either by a prescribed fluid pressure or by a mechanical force from said valve opening/closing bar of the primary-side piston.

2. A cylinder apparatus according to claim 1, wherein said rotation-stopping mechanism for the primary-side piston one in which a seal mechanism is provided on an inner peripheral surface of a through hole formed in a region other than a rod cover passage hole in the rod cover, an operation verification bar provided upright on a surface on said rod cover side of said annular primary-side piston being fitted into said passage hole, and over the entire stroke zone of the primary-side piston within the front cylinder chamber, it is possible for said operation verification bar to slide in the condition of fitting within the passage hole.

3. A cylinder apparatus according to claim 1, wherein a seal mechanism is provided on an inner peripheral surface of a passage hole formed in said head cover, an operation verification bar provided upright on a surface on the head cover side of the annular disc part in the secondary-side piston being fitted into said passage hole, and over the entire stroke zone of the secondary-side piston within the front cylinder chamber, it is possible for said operation verification bar to slide in the condition of fitting within the passage hole.

* * * * *